United States Patent [19]

Durham et al.

[11] 4,269,325

[45] May 26, 1981

[54] CAN VENDING APPARATUS

[75] Inventors: Samuel Durham, Beebe; Max M. Johnston, Russellville, both of Ark.

[73] Assignee: Polyvend, Inc., Conway, Ark.

[21] Appl. No.: 41,878

[22] Filed: May 23, 1979

[51] Int. Cl.[3] ..... G07F 11/00

[52] U.S. Cl. ..... 221/194; 222/224; 222/301

[58] Field of Search ..... 221/289, 298, 299, 301, 221/191, 194, 224

[56] References Cited

U.S. PATENT DOCUMENTS

| | | | |
|---|---|---|---|
| 481,280 | 8/1892 | Kibby . | |
| 562,280 | 6/1896 | Carr | 221/299 |
| 921,763 | 5/1909 | Weed . | |
| 1,139,477 | 5/1915 | Boddy . | |
| 1,986,714 | 1/1935 | Clayton . | |
| 2,240,928 | 5/1941 | Hamel . | |
| 2,279,093 | 4/1942 | Peters | 221/301 X |
| 2,493,223 | 1/1950 | Brock . | |
| 2,575,300 | 11/1951 | Schrager . | |
| 2,590,736 | 3/1952 | Tandler et al. | |
| 2,599,173 | 6/1952 | Hamilton . | |
| 2,777,603 | 1/1957 | Baum . | |
| 2,925,194 | 2/1960 | Mihalek . | |
| 2,956,661 | 10/1960 | Radcliffe . | |
| 2,975,935 | 3/1961 | Hebel . | |
| 2,990,227 | 6/1961 | McCaleb . | |
| 3,057,511 | 10/1962 | Mannhardt . | |
| 3,135,425 | 6/1964 | Korr . | |
| 3,146,907 | 9/1964 | Bookout . | |
| 3,174,646 | 3/1965 | Johnson . | |
| 3,178,055 | 4/1965 | Schuller . | |
| 3,215,241 | 11/1965 | Haefele et al. | 221/298 |
| 3,344,953 | 10/1967 | Krakauer et al. | |
| 4,108,333 | 8/1978 | Falk et al. | 221/191 X |

FOREIGN PATENT DOCUMENTS

| | | | |
|---|---|---|---|
| 483455 | 7/1953 | Italy | 221/298 |

*Primary Examiner*—Joseph J. Rolla

*Attorney, Agent, or Firm*—Hill, Van Santen, Steadman, Chiara & Simpson

[57] ABSTRACT

A can vending apparatus with a hollow chute oriented at an angle with respect to the horizontal, an electrical control circuit, a first and a second mechanism, and an electrically operated horizontal sliding vending door. The two queuing mechanisms and the vending door are operated in sequence by the electrical control circuit. Products are permitted to slide down the hollow chute and are queued between the two queuing mechanisms. The products are permitted to enter the vending area, one at a time, on top of the sliding door under the control of the electrical circuit. At selected intervals of time the vending door is retracted by the electrical control circuit to dispense the product to be vended.

31 Claims, 10 Drawing Figures

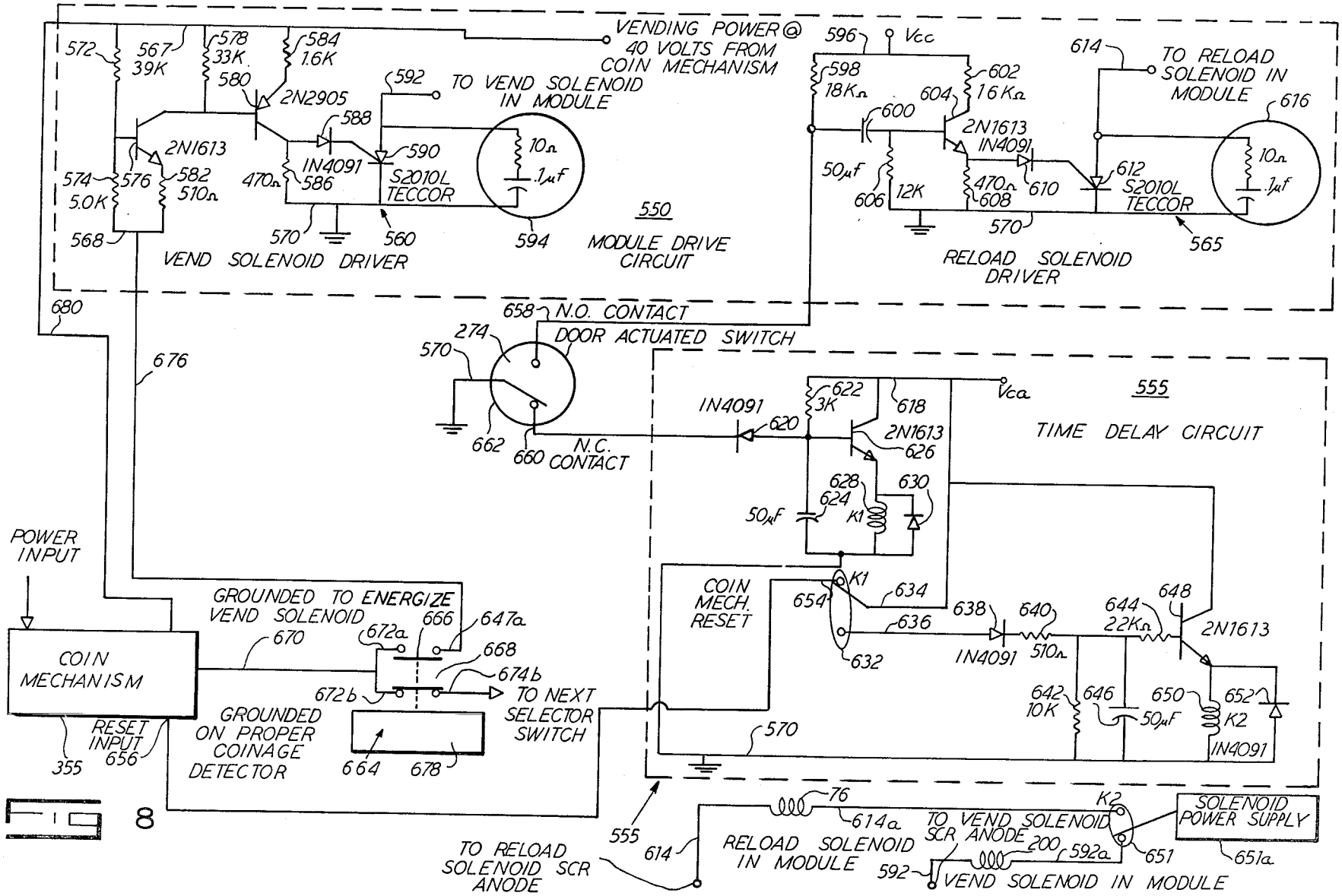
8

CAN VENDING APPARATUS

BACKGROUND OF THE INVENTION

1. Field of the Invention

The invention lies in the field of can dispensing devices for use in vending machines.

2. The Prior Art

Can dispensing devices are well known in the art. There has been a need, however, for a simplified can dispensing apparatus which will dispense various size products so that a purchaser may readily determine what product is to be dispensed next without the need of any auxiliary identification.

SUMMARY OF THE INVENTION

The inventive can vending apparatus has a U-shaped chute with a bottom and two parallel connecting side members. The chute is oriented at an angle with respect to a horizontal and is physically supported by a lower support module. Cans inserted into the chute are urged by the influence of gravity to slide downward from the high end of the chute toward the lower end of the chute.

Two queuing mechanisms extend upward through holes in the bottom of the chute and control the progress of the cans in the chute as they slide toward the lower end of the chute. The two queuing mechanisms are located at selected distance apart from one another. The spacing between the two queuing mechanisms forms a queuing region. One of the two queuing mechanisms is always extended into the chute and the other is always retracted through the bottom of the chute.

The lower end of the chute terminates in a tab or lip which is adjacent a horizontally slidable door. The horizontally slidable vending door slides in a pair of sheet metal tracks which are an integral part of the lower support module. A can to be vended is permitted to slide down the chute, from the queuing region, move across the lower end of the chute, across the tab and onto a top surface of the horizontally slidable vending door. When the horizontally slidable vending door is retracted, the tab at the bottom of the chute forces the can to be vended off the top of the vending door which is being retracted. The vended product then falls into a product dispensing region where it can be accessed by a purchaser.

Each of the two queuing mechanisms has two parallel queuing pins which are spaced laterally across the bottom of the chute and which are joined beneath the chute by a rigid horizontal connecting member. Each pair of parallel queuing pins, joined by the horizontal rigid connecting member forms a U-shaped queuing mechanism. The upper and lower U-shaped queuing mechanisms are joined under the chute by a connecting lever which is pivotally attached to a lower surface of the bottom of the chute. The upper queuing mechanism includes a pair of coil springs, one of which surrounds each of the two queuing pins. Each spring is located between the rigid horizontal connecting member and the lower surface of the bottom of the chute. The effect of the two compression springs associated with the upper queuing mechanism is to bias the lever, the lower queuing mechanism and the upper queuing mechanism such that normally the upper queuing mechanism is retracted through two holes in the bottom of the chute and the lower queuing mechanism extends upward into the chute through two holes in the bottom of the chute.

Cans which are loaded into the chute are thus free to slide down the chute until the lowermost can enters the queuing region and encounters the lower queuing mechanism extending into the chute. A refill solenoid attached to the lower surface of the bottom of the chute is connected to the lever which joins the two queuing mechanisms. The refill solenoid is operable to overcome the two compression springs of the upper queuing mechanism thereby extending the upper queuing mechanism, through the bottom of the chute, into the chute and retracting the lower queuing mechanism through the bottom of the chute. When the upper queuing mechanism is so extended and the lower queuing mechanism is so retracted, the can or other product in the queuing region between the two queuing mechanisms is then free to slide down toward the lower end of the chute, across the lip of the bottom of the chute and onto the horizontally slidable vending door.

A vending solenoid in the lower support module is connected to a rotatably mounted lever arm which is also connected to an end of the horizontally slidable vending door. When the solenoid in the lower module is actuated by supplying electrical power to it, the armature of the solenoid is drawn into the solenoid thus moving the pivotally mounted lever arm causing it to retract the horizontally slidable vending door in the two sheet metal tracks in which the door slides.

A control circuit is operable to, in sequence, first actuate the vending solenoid in the lower module thereby retracting the horizontal vending door and dropping the product to be vended into the product dispensing region. As the horizontally slidable door opens, it, at a selected point, will close a limit switch affixed to the lower support module indicating that the vending door has opened adequately to dispense the product which was located on it. The closure of the limit switch is sensed by the electrical control circuitry which, after a predetermined time, deactivates the door vending solenoid and actuates the solenoid affixed to the lower surface of the bottom of the chute. The queuing pins of the upper queuing mechanism are then extended into the chute blocking the downward movement of all remaining cans in the chute above the upper queuing mechanism. The queuing pins of the lower queuing mechanism are retracted through the two holes in the bottom of the chute thereby permitting the can in the queuing area to slide down the bottom of the chute, across the lip and onto the horizontally slidable vending door which at this time has been permitted to reclose. After a further predetermined time interval, the two queuing pins of the lower queuing mechanism are again extended through the holes in the bottom into the chute and the two queuing pins of the upper queuing mechanism are retracted through the bottom of the chute thereby permitting the cans in the chute to slide downwardly until the lowermost can enters the queuing region and comes in contact with the queuing pins of the lower queuing mechanism. At this point, the vending cycle has been completed.

The lever arm which actuates the horizontally slidable vending door includes an offset hole at one end that locks the horizontally slidable vending door from being manually opened thereby protecting the goods remaining in the dispensing module from theft.

The electrical control circuit includes a module drive circuit for each vending module and a common time delay circuit. Each module drive circuit includes a vending solenoid driver and a reload solenoid driver.

Each vending solenoid driver has a pair of emitter followers connected to provide control signals for a silicon controlled rectifier (SCR). The SCR is connected to one side of the vending solenoid. The other side of the vending solenoid is connected, through a first relay, to a source of electrical energy. When the SCR is caused to conduct it grounds the one side of the vending solenoid thus activating the vending solenoid and causing the vending door to retract dropping the product to be vended into the product dispensing region.

The module mounted switch senses when the door retracts and a time delay circuit which has a timing capacitor is then charged through a resistor of known value. After a predetermined period of time during which the timing capacitor has been charged, a second relay changes state. A drive transistor energizes the first relay which removes power from the vending solenoid allowing the vending door, which is spring biased, to close.

A reload solenoid driver having a drive transistor connected to a control input to a second SCR then energizes the reload or queuing solenoid cycling the upper and lower queuing mechanisms and releasing a can in the queuing region to slide down the chute and onto the horizontal vending door.

After a second predetermined time interval during which a second timing capacitor is discharged through a known resistance, the drive transistor is turned off de-energizing the first relay with the result that the reload solenoid is de-energized. The biasing springs in the upper queuing mechanism return the module to its quiescent state.

A plurality of the above-described vending modules along with a plurality of the electronic control modules may be assembled together in a housing to form a multi-item vending machine. A power supply is operably connected to each of the vending module drive circuits along with a plurality of product selection switches. The product selection switches are operatively connected to one another such that one and only one vending module may be actuated at a time.

A coin box is operatively connected to the power supply and to the plurality of selection switches and electronic control modules. The coin box detects when the input coinage corresponds to a preset price before any of the can vending modules may be actuated. Beneath the plurality of can vending modules is a product dispensing area which is closed by a pivotally mounted product dispensing door attached to the housing of the vending machine. A switch mounted on the product dispensing door and operatively connected to the power supply detects when the door has been opened. An open product dispensing door removes power from a selected module thereby halting the vend cycle to enhance the security of the products still remaining in the vending machine.

The vending modules are suitable not only for vending cans, but for any other product which has an appropriate size and shape and which will slide properly within the vending chute.

BRIEF DESCRIPTION OF THE DRAWINGS

FIG. 8 is a schematic of the module drive electronics represented functionally in FIG. 6;

DETAILED DESCRIPTION OF THE PREFERRED EMBODIMENTS

While the principles of the present invention find a particular utility in a can dispensing apparatus, it should be understood that the inventive can dispensing apparatus may be utilized in other combinations. Not by way of limitation, but by way of disclosure of the best mode of practicing the invention, and to enable one skilled in the art to practice the invention, FIGS. 1–9 disclose one embodiment of the invention.

Figure 1:
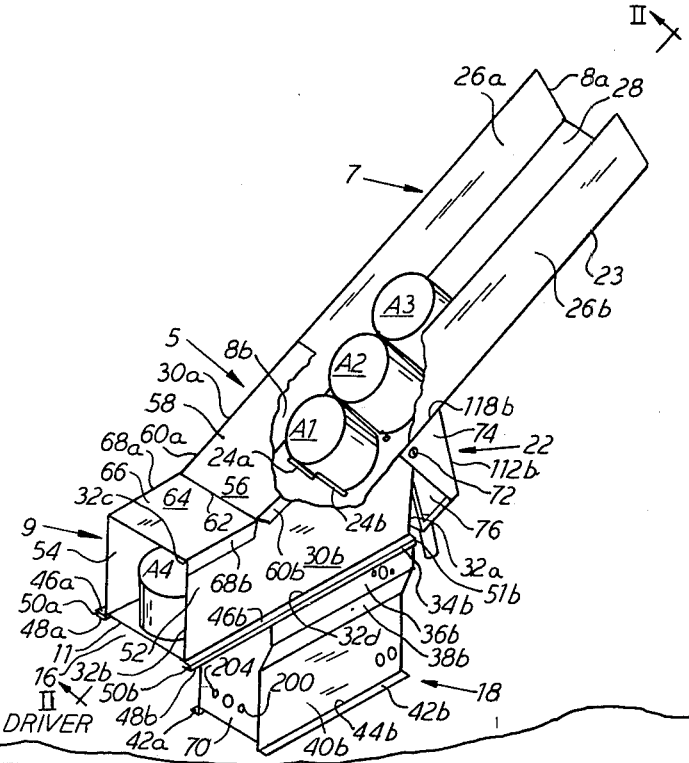
FIG. 1 is a partially broken away perspective view of one embodiment of the inventive product dispensing module.

FIG. 1 is a perspective view of a can dispensing module 5 incorporating the principles of the present invention. The can dispensing mechanism 5 comprises a chute 7, oriented at an angle to the horizontal with an upper end 8*a* and a lower end 8*b*. A product vending end region 9 is affixed to the lower end 8*b* of the chute 7. The chute 7 is formed of any sheet metal of selected thickness.

An electrically controlled vending or product dispensing door 11 forms the floor of the product vending end region 9. Located beneath the vending door 11 is a product delivery area 16. A vended product may be accessed by a purchaser once it has been delivered to the product delivery area 16. The chute 7 and vending end region 9 are physically supported by a lower module base or housing 18. The lower module housing 18 also supports an electro-mechanical apparatus 20 to actuate the vending door 11. A queuing solenoid structure 22 is supported adjacent a lower surface 23 of the chute 7. A set of cans A1–A3 is shown in position in the chute 7 retained by a lower queuing mechanism 24 having a set of queuing pins 24*a*, 24*b*. A can A4 is located on the vending door 11, ready to be delivered to the product delivery region 16.

The chute 7 has a pair of parallel sides 26*a*, 26*b* and a floor 28 perpendicular to the sides 26*a* and 26*b*. Each of the sides 26*a*, 26*b* has a supporting section 30*a*, 30*b* respectively linking the chute 7 to the lower support module 18.

The two supporting sections 30*a* and 30*b* are identical and the following description of section 30*b* is also applicable to supporting section 30*a*. The supporting section 30*b* has a rear vertical edge 32*a*, a front vertical edge 32*b*, a top horizontal edge 32*c* and a lower edge 32*d*. A rectangular guide slot 34*b* essentially perpendicular to the rear vertical edge 32*a* is located adjacent the lower edge 32*d*.

The lower support module 18 has two identical sides, "a" and "b". A description of the "b" side, with respect to FIG. 1 will also apply to the "a" side. Forming the "b" side of the lower support module 18 is a sheet metal lower rectangular region 36*b* adjacent the slot 34*b*, essentially parallel to the region 30*b*. A rectangular region 38*b* is oriented at a selected angle with respect to the rectangular region 36*b*. A lower supporting rectangular region 40*b* also essentially parallel to the regions 30*b* and 36*b*. A supporting tab or strip 42*b* is connected at a bend 44*b* to the lower rectangular support region 40*b*.

The horizontal slot 34*b* has a top elongated surface 46*b*, a parallel bottom surface 48*b* and an intersecting perpendicular edge 50*b*. The function of the guide slot 34*b* is to provide a guide slot wherein the product delivery door 11 may slide essentially horizontally. The slot 34*b* has an open front 51*a* and an open rear 51*b*.

The region 30*b* extends forward and includes a surface 52, bounded by the two edges 32*b, c, d*, which forms the side member of the product vending end region 9. The member 30*a* also extends forward and in a region 54 provides a second side wall, parallel to side wall 52, for the product vending end region 9.

The chute 7 in the vicinity of the two side members 30*a* and 30*b* is covered by a U-shaped member 56. The member 56 has a central connecting portion 58 which extends between the side walls 28*a* and 28*b* and which is held in place by a pair of perpendicular tabs 60*a* and 60*b* soldered or otherwise attached to supporting sections 30*a, b*. Affixed to a front edge 62 of the member 56 is a product vending end region cover 64. The cover 64 has a central horizontal region 66 which connects the two side walls 52, 54 of the product vending end region 9. The central member 66 is held in place by a pair of tabs 68*a* and 68*b* respectively affixed to the side walls 54 and 52 by soldering or other conventional methods.

The lower support module 18 has a front cover 70 which intersects the two side wall members 30*a* and 30*b*. The rear of the lower support module 18 is open.

A screw 72 through a bracket 74 which in turn supports a solenoid 76 affixes the queuing solenoid structure 22 to the support member 30*b* adjacent the edge 32*a* and the elongated rectangular side wall 26*b*.

Figure 2:
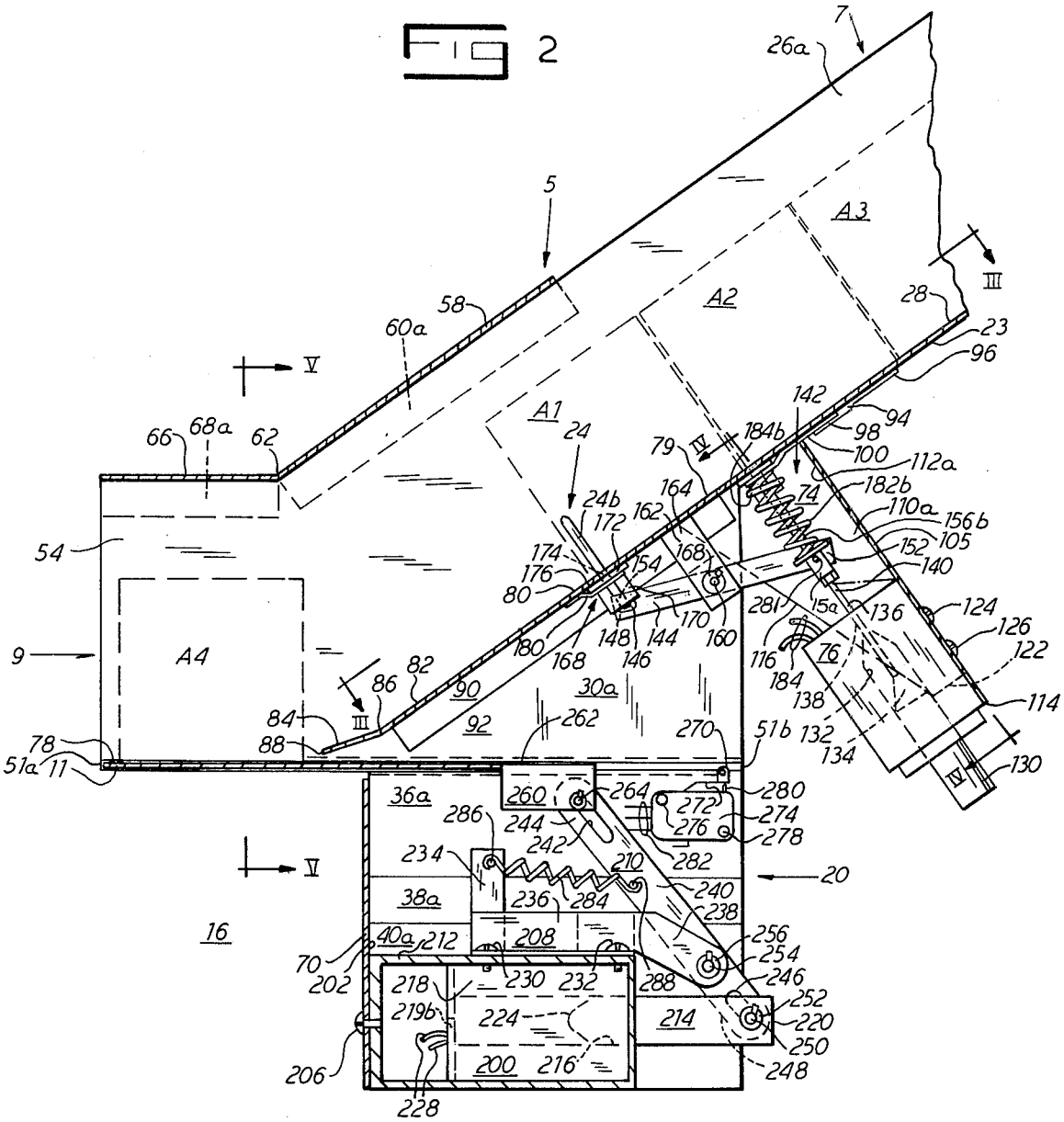
FIG. 2, a section taken along line II—II of FIG. 1, shows the interior detail of the product vending module of FIG. 1.

FIG. 2, a section taken along line II—II of FIG. 1, discloses the interior details of the vending module 5. The item to be vended A4 is shown in the product vending end region 9 resting on a top surface 78 of the horizontally slidable vending door 11. The product A1, which is queued in a queuing region 79 to be vended next by the pair of lower queuing pins 28*a* and 28*b*, rests on a top surface 80 of the floor member 28 of the chute 7. The floor member 28 has a lower front end 82 to which is attached a lip 84 at a bend 86. The lip 84 guides the next product to be vended from the top surface 80 of the floor 28 of the chute 7 onto the top surface 78 of the horizontally slidable vending door 11. A front edge 88 of the lip 84 acts to force the product A4 to be vended off of the top surface 78 of the door 11 as the door 11 is retracted horizontally from beneath the product A4.

The front portion 82 of the floor 28 has affixed thereto a tab 90 which is bent at a 90° angle with respect to the surface 80. The tab 90 is attached to an interior surface 92 of the lower support member 30*a*. Tab 90 may be affixed to the surface 92 in any conventional fashion such as by soldering, brazing or by means of appropriate adhesives. Affixed to the lower surface 23 of the bottom 28 of the chute 7 is a support bracket 94. The support bracket 94 has a rear retaining tab 96 which is brazed or soldered to the surface 23. The bracket 94 also has a front tab 98 which is offset with respect to the surface 23. The offset front tab 98 receives a member 100, a portion of the support bracket 74. The member 100 is slidingly clamped by the front portion 98 of the support bracket 94 to the bottom 28 of the chute 7. The screw 72 and the bracket 94 cooperating together support the queuing solenoid structure 22.

The U-shaped support bracket 74, a part of the queuing solenoid structure 22, has a rear section 105 with two essentially perpendicular side walls 110*a, b* which are perpendicular to the rear section 105. The sections 105, 110*a, b* are also perpendicular to the tab 100. The section 105 has substantially a rectangular shape with two elongated edges 112*a, b* which join side walls 110*a, b* and a shorter perpendicular end 114. The side walls 110*a, b* each have a generally triangular shape. The wall 110*a* has a hypotenuse 116, a base 118*a* adjacent the lower surface 23 of the bottom 28 of the chute 7, and a second side, the edge 112*a*, which adjoins the section 105. The triangular shaped section 110*a* is truncated by an edge 122 which joins the hypotenuse 116 to the edge 112*a*.

The solenoid 76 of a conventional variety is affixed to the member 105 by a pair of screws 124, 126. The solenoid 76 has an armature 130 which is able to move axially in a boring 132 within the solenoid 76 toward or away from the bottom 28 of the chute 7. The armature 130 has a first tapered end 134 to which is affixed a shaft 136 at a first end 138. A second end 140 of the shaft 136 is connected to an upper queuing mechanism 142.

The upper queuing mechanism 142 is connected to the lower queuing mechanism 24 by an elongated member 144 having a hole 146 at a first end 148. The member 144 has a second hole 150 at a second end 152. The lower queuing mechanism 24 comprises the queuing control pins 24*a* and 24*b*, which are substantially in parallel to one another, and which are joined by a member 154 perpendicular to the pins 24*a* and 24*b* which extends through the hole 146 in the member 144. The upper queuing mechanism 142 comprises a set of queuing control pins 156*a* and 156*b*, which are substantially parallel to one another, and which are joined by a perpendicular member 158. The member 158 extends through the hole 150 in the lever 144. The lever 144 pivots about a shaft 160 which is supported by a rectangular bracket 162 which is affixed at an end 164 to the lower surface 23 of the bottom 28 of the chute 7. A split washer 168 retains the pin 160 within the bracket 162.

Each of the pins 24*a*, 24*b*, 156*a* and 156*b* rides in a bushing. A bushing 168 in which the pin 24*b* rides is typical of the bushings associated with the remaining pins and the following description of the bushing 168 will apply to them. The bushing 168 has a lower cylindrical portion 170 to which is affixed an upper disk-like portion 172. Through the portions 170, and 172 there is a boring 174 through which the pin 24*b* extends. An upper surface 176 of the disk member 172 is held adjacent the lower surface 23 of the front portion 80 of the floor 28 by a bracket 180 affixed thereto by soldering or brazing. Each of the pins 24*a, b*, 156*a, b* can slide in the boring of its associated bushing such as the boring 174 of the bushing 168 and enter the chute 7 through selectively placed holes in the bottom 28 of the chute 7. With respect to the upper queuing assembly 142, a coil spring 182*a* is located adjacent the connecting bar 158, surrounding the vertical pin 156*a*. A corresponding spring 182*b* surrounds the pin 156*b* and is located against one end of the elongated connecting member 158. A second end 184*a, b* of each of the springs 182*a, b* is located adjacent a surface 186*a, b* on the bracket supporting bushing associated with each of the queuing pins 156*a, b*. The springs 182*a, b* bias the assembly 142 such that if the solenoid 76 has not been activated, the pair of queuing pins 24*a* and 24*b* extends upwardly through the borings such as the boring 174 in the bushings associated therewith. The queuing pins 156*a* and 156*b* under the influence of the springs 182*a, b* are retracted so that they do not extend up through the floor 28 of the chute 7. When the solenoid 76 is actuated by power supplied to a pair of wires 184 the armature 130 moves toward the floor 28 of the chute 7 overcoming the biasing springs 182*a, b* thereby causing the pins 156*a* and 156*b* to extend up through the floor 28 through a pair of holes 190*a* and 190*b* in the floor 28 of the chute 7. Similarly, the effect of the armature 130 of the solenoid 76 moving toward the floor 28 is to retract the pins 28*a, 28b* in their associated bushings through a pair of holes 192*a, 192b* in the front section 80 of the floor 28 of the chute 7. When the pins 24*a, 24b* are retracted, the next item to be vended, such as the item A1, slides down the surface 80, across the bend 86, onto the lip 84 and comes to rest on the surface 76 of the retractable vending door 11.

The apparatus 20 for retracting the horizontally sliding vending door 11 is contained in the lower support module 18. A solenoid 200 is attached to an interior surface 202 of the front panel 70 of the lower support module 18 by a pair of screws 204, 206. A bracket 208, a lever arm 210 and the solenoid 200 cooperate so as to retract the vending door 11. The solenoid 200 has an external housing structure 212, an armature 214, and a boring 216 located within a body portion 218 which contains the electrical windings used to activate the solenoid 200. A boring 219*a* within the housing 212 is coextensive with a boring 219*b* in the body 218 of the solenoid 200. A further boring 219*c*, through the front panel 70 is also coextensive with the borings 219*a, b*.

The armature 214 has an external end 220 and an internal end 224. When electrical energy is input to the solenoid 200 by a pair of input wires 228, the end 224 of the armature 214 is drawn toward the screw 206. The bracket 208 is affixed to the housing 212 by a pair of screws 230, 232. The bracket 208 has an L-shape with a shorter vertical portion 234 affixed to an elongated horizontal portion 236. An end portion 238 is affixed to the horizontal portion 236 at a slight angle with respect thereto. The lever 210 has an elongated body 240 with an upper elongated slot 242 adjacent a first end 244 of the body 240. A second elongated slot 246 is adjacent a second end 248 of the member 240.

The end 220 of the armature 214 of the solenoid 200 is rotatably attached to the end 248 of the elongated body member 240 by a pin 250 which is affixed to the end 220 of the armature 214 and which extends through the elongated slot 246 of the member 240. The member 240 is held onto the pin 250 by a split washer 252.

The lever 210 is also rotatably attached to the end 238 of the bracket 208 by a pin 254 affixed to the end 238 of the bracket 204. The pin 254 extends through a boring in the lever 210. A split washer 256 clamps the end 238 of the bracket 208 to the lever 240. For purposes of attaching the horizontally slidable vending door 11 to the end 244 of the lever 210, an elongated rectangular tab 260 is affixed to an end 262 of the door 11. Affixed to the elongated member 260 is a pin 264 which slidably engages the elongated slot 242 of the lever 210.

When the solenoid 200 is energized by electrical power through the wires 228, the armature 214 moves toward the screw 206. As the end 220 also moves toward the screw 206, the end 248 of the lever 210 is forced to pivot about the pin 254 which causes the end 244 of the lever 210 to move away from the front panel 70. Because the end 244 of the lever 210 is rotatably attached to the elongated member 260 which is affixed to the end 262 of the slidable door 11, the door 11 is retracted along the slots 34*a* and 34*b*. When the end 262 of the door 11 is retracted sufficiently, a cam surface 270 on an arm 272 of a limit switch 274 is intersected. The switch 274 is affixed to the side wall 36*b* of the lower support module 18 by a pair of screws 276, 278. The function of the switch 274, typically a microswitch, is to sense when the horizontally retractable door 11 has been retracted in the slots 34*a* and 34*b*. When the end 262 of the door 11 approaches the cam surfaces 270, the cam surface 270 is forced downwardly on the arm 272 which in turn displaces a switch arm 280 downward thereby closing the switch 274. The change of state of the switch 274 may be sensed by output wires 282. After the door 11 has been fully retracted passing partially beyond the open end 51*b*, and sensed by the switch 274, the solenoid 200 is de-energized. When the solenoid 200 is de-energized, a biasing spring 284 affixed to a point 286 of the vertical portion 234 of the bracket 208 and at a hole 288 on the lever arm 210, which had previously been stretched by the movement of the armature 214 toward the screw 206, contracts pulling the end 244 of the lever arm 210 toward the sheet metal front panel 70 of the lower support module 18. The contraction of the spring 284 recloses the door 11.

Figure 3:
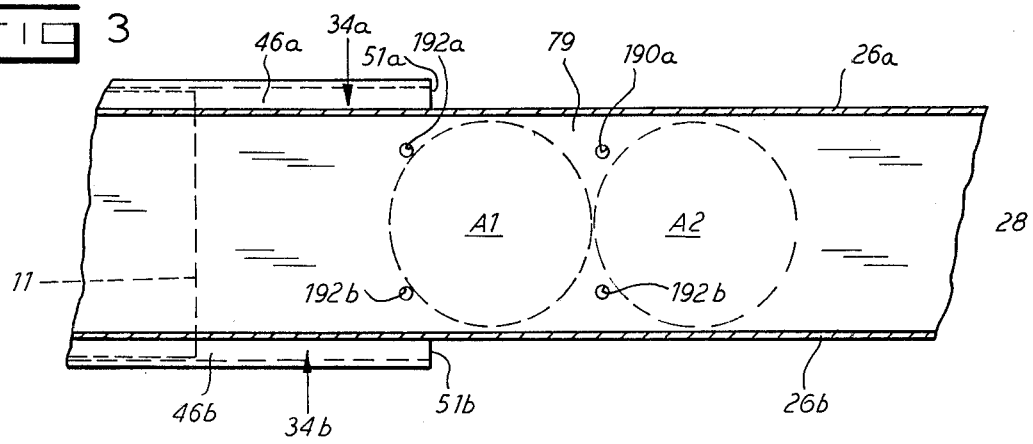
FIG. 3, a section taken along line III—III of FIG. 2, shows the detail of the vending chute.

FIG. 3, a top view of the chute 7 taken along line III—III of FIG. 2, shows a product A1 which has been queued in the queuing region 79 between the queuing pins 24*a* and 24*b* and 156*a* and 156*b*. As shown is a product A2 which is located upwardly of the queuing pins 156*a* and 156*b* and which would be the next product to enter the queuing region 79. FIG. 3 shows the relationship between the two side walls 26*a* and 26*b* of the chute 7 and the bottom 28 of the chute 7 with respect to the two sets of queuing pins 24*a, 24b*, 156*a* and 156*b*. Additionally, FIG. 3 shows the borings 190*a, 190b* and 192*a* and 192*b* through the bottom 28 of the chute 7 associated respectively with the queuing pins 156*a, 156b, 24a* and 24*b*. The two sets of horizontal slots 34*a, b* wherein the vending door 11 slides are also shown.

Figure 4:
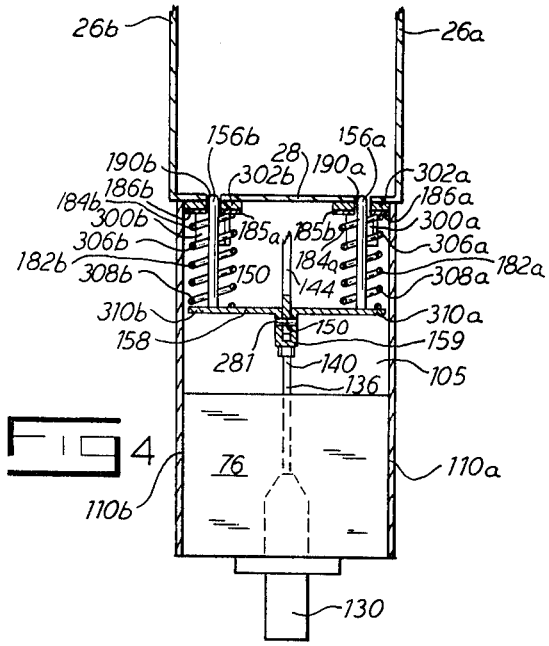
FIG. 4, a section taken along line IV—IV of FIG. 2, shows the detail of the upper queuing mechanism.

FIG. 4, a section taken along line IV—IV of FIG. 2, discloses the detail of the upper queuing mechanism 142. The two upper queuing pins 156*a* and 156*b* are shown connected by the rigid connecting member 158 to form the upper U-shaped queuing mechanism 142. Surrounding the pins 156*a* and 156*b* are the two biasing springs 182*a, b*, respectively. The rigid connecting member 158 is shown linked to the lever arm 144 by a linking member 159. The aperture 150 at the end 152 of the lever arm 144 is shown engaging a pin 281 which is located within the linking member 159. The linking member 159 is connected to the end 140 of the shaft 136 which is in turn connected to the armature 130 of the solenoid 76.

FIG. 4 also discloses a pair of lower cylindrical bushing members 300*a* and 300*b* which are connected to a pair of upper disk shaped bushing members 302*a* and 302*b*. The springs 182*a,b* are retained at a pair of upper ends 184*a, b* by respective lower surfaces 186*a, b* of bushing clamps tabs 185*a, b*. A pair of lower ends 308*a, b* of the springs 182*a, b* are retained by a pair of ends 310*a, b* of the rigid connecting member 158. The supporting bracket 74 for the solenoid 76 having the rear panel 105 with the pair of substantially triangular side panels 110*a* and 110*b* is also shown.

Figure 5:
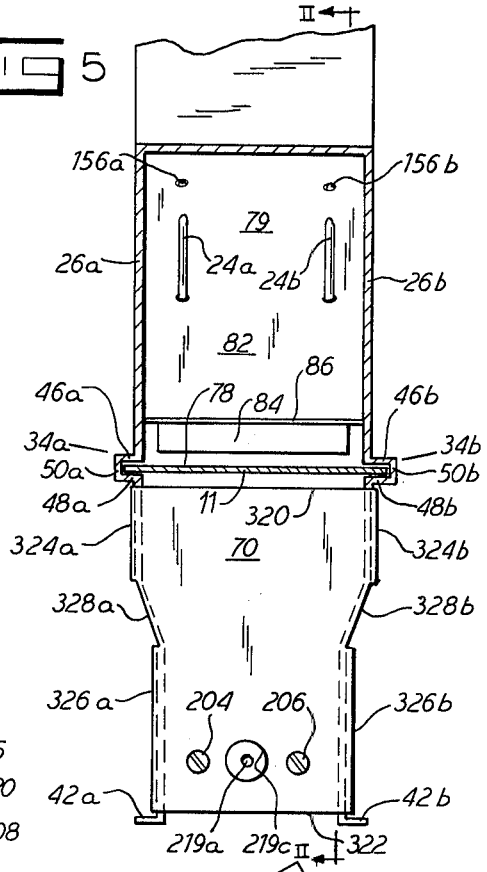
FIG. 5, a section taken along line V—V of FIG. 2, shows the detail of the lower end of the vending chute.

FIG. 5, a sectional view taken along line V—V of FIG. 2, discloses the product dispensing lower end 82 or the chute 7. In FIG. 5, the product queuing region 79 is shown between the lower queuing pins 24*a* and 24*b*, shown normally extended, and the upper queuing pins 156*a* and 156*b* shown normally retracted. The lower end 82 of the chute 7 has the connected product delivery lip 84 adjacent the upper surface 78 of the horizontally slidable vending door 11.

The two external U-shaped slots 34*a, b* having the top and bottom sides 46*a, b* and 48*a, b* with connecting sides 50*a, b* are shown slidingly supporting the door 11. Additionally, the front panel 70 of the lower module 18 is also shown in FIG. 5. The panel 7 has a top edge 320 and a parallel bottom edge 322. A straight side edge 324*a* substantially perpendicular to the top edge 320 is parallel to a second straight side edge 326*a* which is substantially perpendicular to the bottom edge 322. The two edges 324*a* and 324*b* are joined by a connecting edge 328*a* at an angle corresponding to the acute angle between the lower module panels 40*b* and 38*b*. Similarly, a first and second straight edge 324*b* and 326*b* are joined by an interconnecting edge 328*b*. Each of the edges 324*a, b*, 326*a, b* and 328*a, b* is folded against a corresponding side surface 36*a, b*, 40*a, b* and 328*a, b* of the lower support module 18. The lower screws 204 and 206 rigidly connect the solenoid housing 212 to the front panel 70. The borings 219*a, c*, which provide access to the end 224 of the solenoid armature 214 appear between the screws 204 and 206. The two lower support flanges 42*a* and 42*b* are also shown.

A vending sequence is initiated by a customer depositing an appropriate group of coins through a coin slot in a vending machine of which the module 5 is a part. One important feature of this invention is that because the next product to be vended, A4, is seen by the purchaser, no auxiliary signs are needed. Additionally, different can products may be mixed in the chute 7. Upon selecting of the product A4 in any conventional fashion for such vending machines, the solenoid 200 is actuated thereby drawing the armature 214 into the boring 216. As a result, the actuating arm 210 pivots about the pin 254 causing the upper end 244 of the arm 210 to move toward the limit switch 274. The tab 260 which is pivotably connected to the lever 210 and affixed to the door 11 is also forced to move toward the limit switch 274. This retracts the door 11 thereby dropping the selected product A4 into the product delivery region 16 beneath the door 11. The rearward travel of the door 11 and the associated tab 260 brings a rear end 262 of the door 11 into contact with the actuating arm 272 thereby closing the switch 274.

The closure of the switch 274 actuates a time delay relay. Concurrently, power is withdrawn from the solenoid 200 and the biasing spring 284 connected to the lever 210 recloses the door.

The solenoid 76 is then actuated by the time delay relay. The armature 130 moves into the boring 132 thereby pivoting the queuing lever 144. As the queuing lever 144 pivots about the pivot point 160, the front end 148 causes the two queuing pins 24*a, b* to be retracted in the associated cylindrical bushings such as the bushing 264. As a result, the queued product A1 is allowed to slide from the queuing region 78, down the lower end 80 of the chute 7, across the product delivery tab 84 and take a position as the next product to be vended on the top surface 78 of the vending door 11. Simultaneously, the end 152 of the queuing lever 144 moves upward toward the floor 28 of the chute 7 thereby extending the two queuing pins 156*a, b*. This extension of the two queuing pins 156*a, b* blocks passage of the next product A2 and any succeeding products behind it. As a result, only product A1, in the queuing region 78, is permitted to slide onto the upper surface 78 of the door 11 to be vended.

When the time associated with the time delay expires, the solenoid 76 loses its source of energy, and the biasing springs 182*a, b* which surround the pins 156*a, b* expand thereby driving the rear edge 152 of the queuing lever 144 downward toward the solenoid 76. As a result, the queuing pins 156*a, b* are retracted beneath the bottom 28 of the chute 7. The lower pins 24*a, b* are extended into the chute 7. The product A2 is permitted to slide into the queuing region 78. Thus, a vending cycle has been completed wherein a single product A4 has been dispensed into the region 16 wherein it may be accessed by the purchaser. A second product A1 has been queued on the top 78 of the door 11 ready to be dispensed and a third product A2 has been queued in the queuing region 78 for dispensing subsequently.

Figure 6:
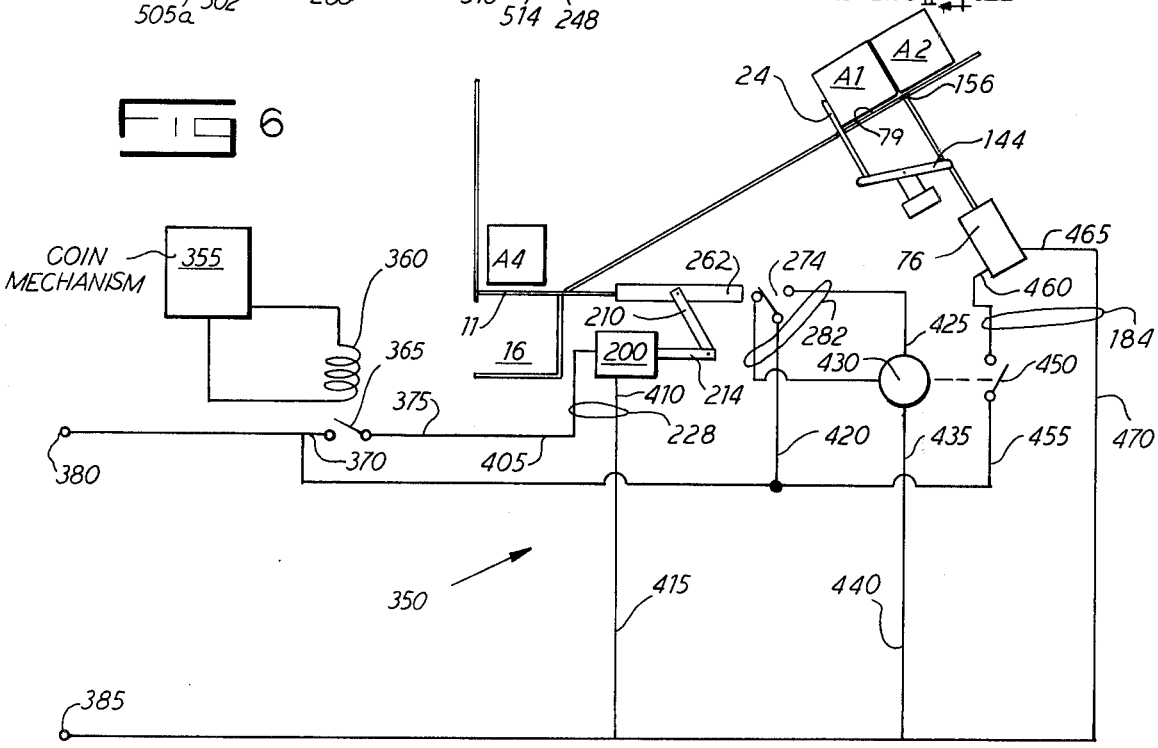
FIG. 6 is a functional schematic showing the interrelationship of the electrical and mechanical parts of the vending module of FIG. 1.
Figure 10:
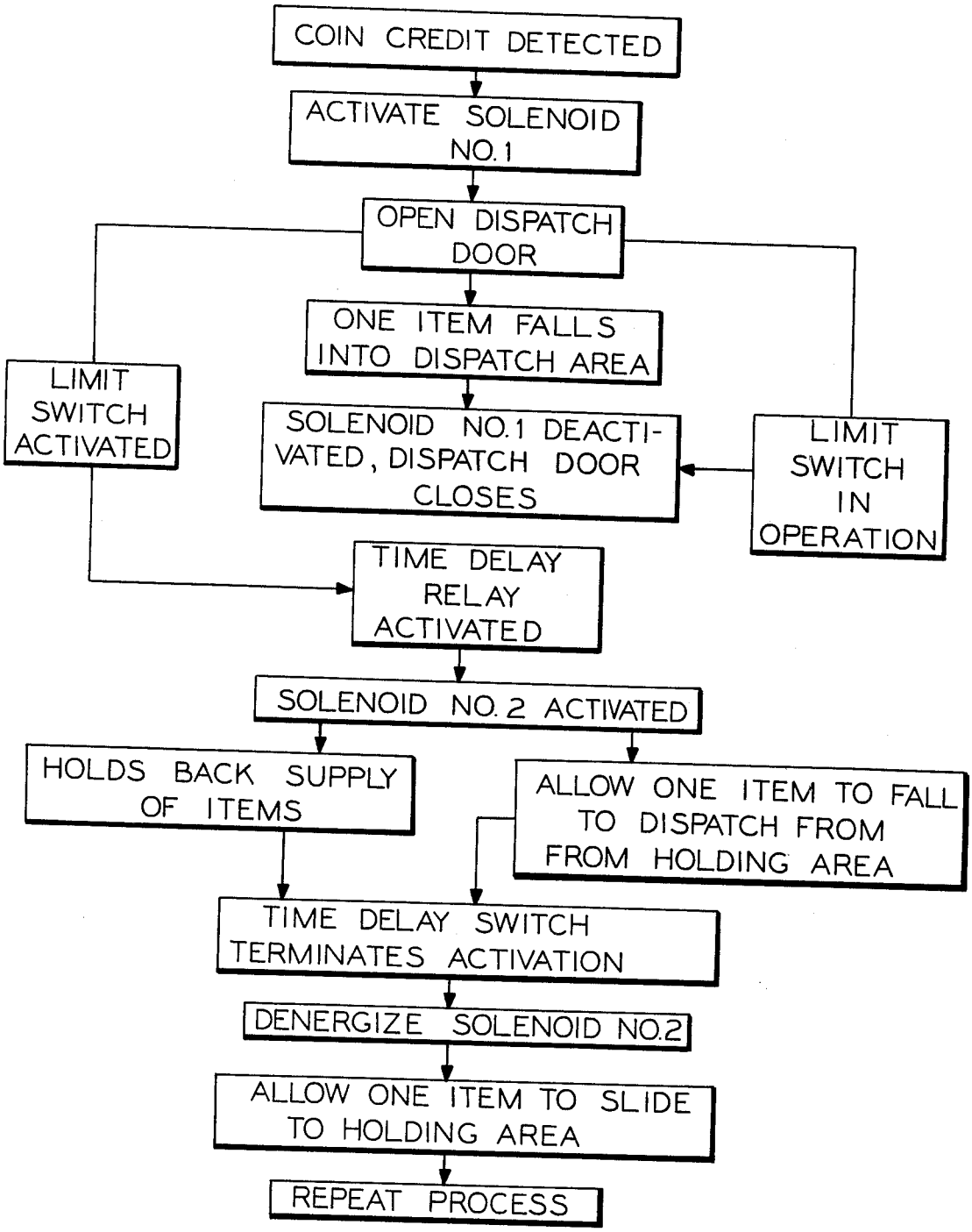
FIG. 10 is a flow diagram of the dispensing operation of the vending machine.

A functional schematic of the electrical control circuitry 350, for the can vending module 5 is in FIG. 6. A coin registration mechanism of a conventional variety 355 is connected to a coil 360 of a control relay having a contact 365. The contact 365 has a first side 370 and a second side 375. A source of power is connected to a set of input terminals 380, 385. When the contact coinage is deposited through the can sensing mechanism 355, that mechanism energizes the coil 360 thereby closing the contact 365. Power is supplied through the terminal 380 through the input side 370 of the contact 365 through the output side 375 and to the solenoid 200 along a line 405. The solenoid 200 is connected by a wire 415 to the terminal 385. As a result, the solenoid 200 is energized. The actuating lever 210 retracts the door 11 toward the limit switch 274 thereby permitting the article A4 to be dispensed into the region 16 where it may be accessed by the purchaser. As the sliding door 11 moves toward the switch 274 the rear surface 262 at some point, when the travel has been adequate closes the switch 274. A line 420 is connected to a pole of the switch 274 which is directly connected to the power terminal 380. Thus, when the switch 274 is actuated, power is supplied along the line 420 through the contacts of the switch 272 to a terminal 425 of a time delay relay 430. A second terminal 435 of the time delay 430 is directly connected by a line 440 to the second power terminal 385.

When the switch 274 is actuated due to the motion of the rearward surface 262 of the door 11, a single-pole single-throw contact 450 controlled by the time delay relay 430 is also caused to be closed. Closure of the contact 450 which is connected by a line 455 to the power terminal 380 supplies power to a terminal 460 of the solenoid 76. A second terminal 465 of the solenoid 76 is connected by a line 470 to the power terminal 385. Thus, energizing the time delay 430 which results in closing the contact 450, will energize the solenoid 76 for a known period of time. Energizing the solenoid 76 for a known period of time operates the lever arm 144 which in turn causes the queuing pins 24*a, b* to be depressed thus releasing the product A1 in the queuing region to slide down the surface 80 to the vending door 11 to be dispensed subsequently. Simultaneously, the upper queuing pins 156*a, b* are extended through the bottom or floor 27 into the chute 7. Item A2 and subsequent items further up in the chute 7 are blocked from sliding into the dispensing area on top of the sliding door 11. Once the time delay relay 430 times out and the solenoid 76 is no longer being energized, the springs 182*a, b* associated with the queuing pins 156*a, b* cause them to retract beneath the floor 28 which in turn permits product A2 to enter the queuing region 79.

Figure 7:
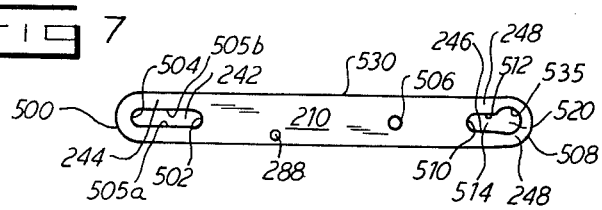
FIG. 7, an elevation of the linkage arm for the product dispensing doors shows the detail of the mechanical locking mechanism associated with the horizontally slidable vending door.

FIG. 7 discloses the details of the lever arm 210 which cooperates with the solenoid armature 214 to retract the horizontal slidable vending door 11. The lever arm 210 has the end 244 with a circular edge 500. The elongated rectangular slot 242 has a pair of circular edges 502, 504. The circular edge 504 is adjacent the external circular edge 500 of the end 244. A pair of straight parallel edges 505*a, b* connects the circular edges 502, 504. Spaced axially along the member 210 from the circular edge 502 of the slot 242 is the hole 288 to which the one end of the spring 284 is affixed. A hole 506 axially with respect to the hole 288 corresponds to the hole through which the pin 254 passes and around which the lever arm 210 rotates. The second end 248 has a circular external edge 508. The elongated slot 246 adjacent the end 248 has a first circular edge 510 which intersects a pair of substantially straight parallel edges 512, 514. Adjacent the external circular edge 508 the slot 246 has a larger diameter hole 520 whose center is offset with respect to the center of rotation of the circular edge 508. The edges of the hole 520 intersect the two edges 512, 514 completing the slot 246. The lever arm 210 has an elongated edge 530 which joins the two external circular edges 508, 500 and which is oriented toward the solenoid 76 when installed.

The purpose of the offset hole 520 in the end 248 of the lever arm 210 is to provide a mechanical locking means which would prevent an intruder from manually retracting the door 11 to thereby gain access to the product such as the products A1 through A4 within the module 5. When an intruder attempts to retract the sliding door 11, when the solenoid 200 has not been energized, a slight horizontal rearward motion of the door 1 moves the top end 244 of the lever 210 toward the switch 274. This slight motion causes the lever arm 210 to pivot around the point 254 which in turn causes the pin 250 of the solenoid armature 214 to seat against the rear surface 535 of the offset hole 520. This movement of the end 248 of the lever 210 so that the surface 535 of the hole 520 bears against the pin 250 locks the door 11 from opening further. Thus, products A1 through A4 are protected from pilferage or other unauthorized removal.

FIG. 8 is a schematic setting forth one particular electronic embodiment of the functional circuit of FIG. 6. The circuit of FIG. 8 comprises a module drive circuit 550, one of which is associated with each cam vending module such as the module 5 and a time delay circuit 555, one of which may be associated with a group of modules 5. The module drive circuit is comprised of two sections, a vend solenoid driver circuit 560 and a reload solenoid driver 565.

The vend solenoid driver 560 comprises a power supply bus 567, a control bus 568 and a ground bus 570. A resistor 572 is connected on one end to the power bus 567 and on a second end to a resistor 574 and the base input of a transistor 576. The other end of the resistor 574 is connected to the control bus 568. A third resistor 578 has one end connected to the power bus 567 and the other end connected to a collector of the transistor 576 and a base input of a transistor 580. A fifth resistor 584 has one end connected to the power bus 567 and the other end connected to an emitter input of the transistors 580. A sixth resistor 586 is connected between the ground bus 570, and a collector of the transistor 580. The collector of the transistor 580 is also connected to an anode of the diode 588. A cathode of the diode 588 is connected to a control input of the silicon controlled rectifier (SCR) 590. A cathode of the SCR 590 is connected to the ground bus 570. An anode of the SCR 590 is connected by a wire 592 to the vend solenoid 200 in the module 5. A suppression circuit 594 is connected between the wire 592 and the ground bus 570.

The reload solenoid driver 565 has a power bus 596 which in the preferred embodiment has a voltage of about +40 volts DC. A first resistor 598 is connected between the power bus 596 and a first terminal of a capacitor 600. A second resistor 602 is connected between the power bus 596 and a collector of a transistor 604. A second terminal of the capacitor 600 is connected to a base input of the transistor 604. A third resistor 606 is connected at a first terminal to the base of the transistor 604 and at a second terminal to the ground bus 570. A fourth resistor 608 is connected at a first terminal to an emitter of the transistor 604 and an anode of the diode 610. A second terminal of the resistor 608 is connected to the ground bus 570. A cathode of the diode 610 is connected to a control input of SCR 612. A cathode of the SCR 612 is connected to the ground bus 570. An anode of the SCR 612 is connected by a wire 614 to the reload solenoid 76 in the module 5. A transient suppression circuit 616 is connected between the wire 614 and the ground bus 570.

The time delay circuit 555 has a power distribution bus 618 which supplies approximately 40 volts DC to the circuit. An input diode 620 has an anode connected to a first terminal of a resistor 622 and a first terminal of a capacitor 624. A second terminal of the resistor 622 is connected to the power bus 618. A second terminal of the capacitor 624 is connected to the ground bus 570. A base for a transistor 626 is connected to the anode of the diode 620. A collector terminal of the transistor 626 is connected to the power bus 618. An emitter terminal of the transistor 626 is connected to a first input of a relay coil 628 and to an anode of a transient suppression diode 630. A second terminal of the relay coil 628 is connected to the ground bus 570. An anode connection to the diode 630 is also connected to the ground bus 570. A single-pole, double-throw relay contact 632 associated with the coil 628 has a pole connection connected to the power bus 618. A normally open connection 636 is connected to an anode of a threshold diode 638. A cathode of the diode 638 is connected to a first terminal of a resistor 640. A second terminal of a resistor 640 is connected to a first terminal of the resistor 642, a first terminal of the resistor 644, and a first terminal of the capacitor 646. A second terminal of the resistor 642 and a second terminal of the capacitor 646 are each connected to the ground bus 570. A second terminal of the resistor 644 is connected to a base input of a transistor 648. A collector of the transistor 648 is connected to the power bus 618. An emitter of the transistor 648 is connected to a first input of a relay coil 650 and to a cathode of a transient suppression diode 652. A second input to a relay coil 650 is connected to the ground bus 570. To anode of the voltage suppression diode 652 is also connected to the ground bus 570. A normally closed contact 634 of the contact 632 is connected to a reset input 656 of the coin mechanism 355.

The door mounted switch 274 has a normally open contact 658, a normally closed contact 660 and a pole 662. The pole connection 662 is connected to the ground bus 570. The normally closed contact 660 is connected to a cathode of the input diode 620. The normally open contact 658 is connected to a second input of the resistor 598 and a first input of the capacitor 600. A product selector switch 664 having a normally open pole 666 and a normally closed pole 668 is used to activate the module drive circuit 550. An output line 670 from the coin mechanism 355 is connected to a pair of inputs 672*a* and 672*b* of the switch 664. An output contact 674*a* associated with the normally open pole 666 is connected by a line 676 to the control bus 568 in the vending solenoid driver 560. A second output 674*b*, associated with the normally closed pole 668 is connected to the next selector switch as the line 670 is connected to the switch 674. The switch 674 also has an actuating cap 678 which when depressed opens the pole 668 and closes the pole 666.

An operational vending sequence proceeds as follows. Coins are inserted into the coin mechanism 355 which is a conventional product and which is connected to the power bus 567 along the line 680 as well as to the selector switch 664 along the line 670. When the switch 664 is depressessed opening the pole 668 and closing the pole 666, and when the coil mechanism 355 in a known fashion detects the appropriate coinage, line 670 has a ground potential place thereon and line 680 has vending power at about 40 volts placed thereon. The ground signal along line 670 is applied through pole 666 along line 676 to the control bus 568. With a grounded control bus 568, the transistor 576 is permitted to conduct, which in turn lowers the voltage at the base of transistor 580 permitting it to conduct. When transistor 580 conducts, current flows through the resistor 584 and through the resistor 586 establishing a voltage at the anode of the diode 588. The diode 588 merely acts as a threshold diode to minimize undesirable turn-on of the SCR 590. When the voltage is established at the anode of the diode 588, the SCR 590 is driven to the conduction state, thereby essentially grounding the line 592 which in turn permits a current to flow through the solenoid 200 from the solenoid supply 651*a*.

When the solenoid 200 is energized, the vending door 11 is then retracted. As the vending door 11 retracts, at some point, it will encounter the door actuated switch 274. When the door actuated switch 282 is encountered, the pole 662 changes state closing through ground the contact 658 which grounds the first side of the capacitor 600 of the reload solenoid driver 565. With the first side of the capacitor 600 held at ground through the contact 658, the transistor 604 stays turned off.

With the contact 660 open circuited, the capacitor 624 of the time delay circuit 555 is permitted to charge through the resistor 622, thereby establishing a first time delay of a known duration. When the voltage across the capacitor 624 is sufficiently high, the transistor 626 will start to conduct thereby permitting a current to flow through the coil 628. When a sufficient current flows, the coil 628 causes the contact 632 to change state. When the output 654 of the contact 632 becomes open circuited the coin mechanism 355 is reset by the input 656. Simultaneously, the voltage on the voltage bus 618 is applied to the output 636 of the contact 632 forward biasing the diode 638 and causing current to flow through the resistor 640 and the resistor 642 simultaneously charging the capacitor 646.

The capacitor 646 charges up fairly quickly. When the capacitor 646 is charged adequately the voltage at the base of the transistor 648 is high enough so that the transistor 648 starts to conduct, current flows through the base resistor 644. When the transistor 648 conducts, current flows through the coil 650 of the second relay thereby switching the relay contacts 651. When the relay contacts 651 are switched voltage from the solenoid power supply 651*a* is supplied to the solenoid 76. When the contacts 651 change state, voltage is removed from the vending solenoid 200. Because of the presence of the biasing spring 284 in the lower support module 18 the door 11 starts to reclose.

As the door 11 recloses, the switch 274 assumes its normal position. When the switch 274 assumes its normal position, line 658 becomes open circuited, thereby permitting current to flow from the supply bus 596, through the resistor 598 and to charge the capacitor 600. As current flows through the capacitor 600 and subsequently through the resistor 606 into the ground bus 570, the transistor 604 is caused to conduct. When the transistor 604 conducts, current flows through the resistor 602 and the resistor 608 establishing a voltage at the anode of the diode 610. The voltage of the anode of the diode 610 is transmitted through the diode 610 to the control input of the SCR 612, thereby triggering the SCR 612 and placing a substantially ground potential on the line 614. The solenoid 76 thus will have a ground potential on one input 614 and will have a voltage from the solenoid power supply 651*a* applied to the other input 614*a*, thereby causing the load solenoid to cycle the upper end lower queuing mechanisms 142, 24. The queuing pins 156*a* and 156*b* of the upper queuing mechanism 142 will be driven through the bottom 28 of the chute 7 into the chute thereby blocking downward travel of products 82 and 83. The pins 24*a*, *b*, of the lower queuing mechanism 24 will be retracted through the bottom 28 of the chute 7, thereby permitting the product A1 in the queuing region 79, to slide down the lower end of the chute 82, across the lip 84 and come to rest on top surface 78 of the horizontally retractable door 11.

As the normally closed contact 660 returns to its normally closed state due to the door 11 having moved away from the door actuated switch 274, a ground potential is placed at the cathode of the input diode 620. The ground potential at the cathode of the diode 620 will discharge the capacitor 624 fairly quickly. As the capacitor 624 discharges its causes the transistor 626 to turn off which in turn blocks current flow through the coil 628. The voltage suppression diode 630 conducts at this time thereby suppressing any voltage transient which might be developed across the coil 628. The contacts 632 returned to their normal state with the pole 634 applying potential from the voltage bus 618 to the output contact 654. In this condition the contact 636 is open circuited which permits the capacitor 646 to discharge through the resistor 642 and the resistor 644. When the capacitor 646 has discharged sufficiently the transistor 648 will cease conduction thereby blocking current flow through the coil 650. The suppression diode 652 will conduct at this time to suppress any voltage transients which might be generated across the coil 650. As current flow decreases through the coil 650 the related contacts 651 assume their original state with the solenoid power supply 651*a* connected to the line 592*a* of the vending solenoid 200. At this time the reload solenoid 612 also turns off. The module drive circuit 550 has now returned to its original quiescence state and is prepared to receive the next input through the selector switch 664.

In the preferred embodiment it should be noted that the time delay associated with the 3000 ohm resistor 622 and the 50 microfarad capacitor 624 is on the order of 0.15 seconds.

Figure 9:
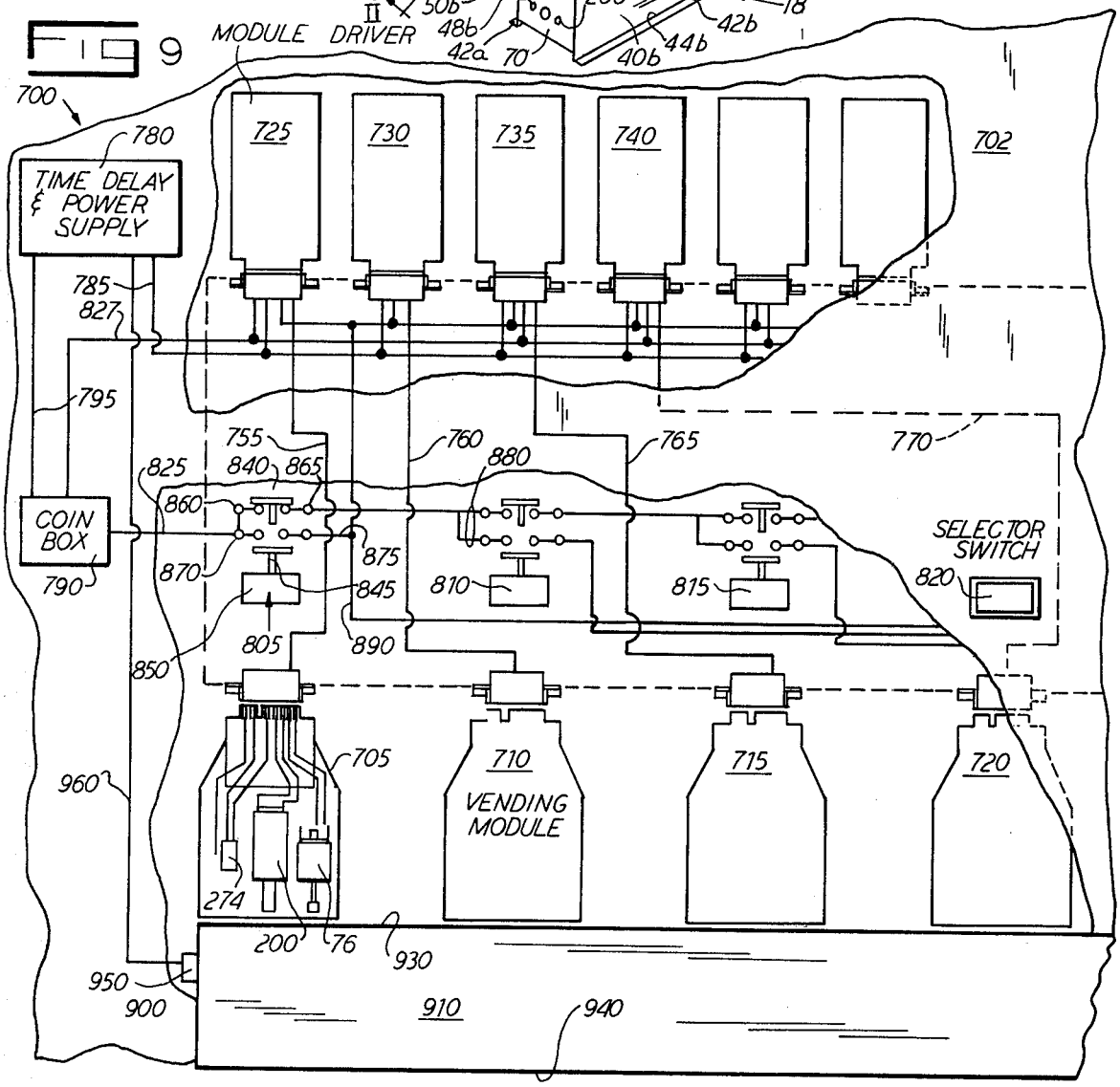
FIG. 9 is a partially broken away schematic view of a vending machine incorporating the vending modules of FIG. 1.

FIG. 9 is an exemplary vending machine 700 incorporating a plurality of the can vendor modules 5. The vending machine 700 has a housing 702 and includes a group of vending modules 705, 710, 715 and 720. Each of the vending modules 705 through 720 is identical to the exemplary can vending module 5. Operably connected to the vending modules 705 through 720 is a plurality of module drivers 725, 730 and 735 and 740. Each of the module drivers 725 through 740 corresponds to the module drive circuit 550 of FIG. 8. Each of the module drivers 725 through 740 is operably connected to a corresponding vending module 705 through 720 through a multiconductor cable 755, 760, 765, and 770. A conventional power supply 780 incorporating the time delay circuit 555 of FIG. 8 is operably connected by a cable 785 to each of the module drivers 725 through 740. A coin box 790 of a conventional variety operable to receive coins and compare the input coinage to a preset price is affixed to the housing 702. The coin box 790 is operably connected to the power supply 780 by a multiconductor cable 795, to a plurality of selector switches 805, 810, 815 and 820 by a second cable 825 and to each of the drive modules 725–740 by a multiconductor cable 827.

Each of the selector switches 805 through 820 is identical to the switch 664 of FIG. 8 and is wired similarly. The switch 805 is typical of the switches 805 through 820 and a description of the switch 805 and its connectivity will also describe the remaining selector switches 810 through 820. The switch 805 has a first normally closed, pole 840 and a second, normally open, pole 845 mechanically connected and operable through a push button 850. The first pole 840 has an input connector terminal 860 and an output connector terminal 865. The second pole 845 has an input connector terminal 870 and an output connector terminal 875. The cable 825 from the coin box 790 is connected to the two inputs 860, 870. The output 865 goes to a corresponding pair of inputs 880 on the adjacent selector switch 810. The output 875 is connected via a multiconductor cable 890 to corresponding module driver 725. The switches 810 through 820 each are wired to a corresponding module driver 730 through 740 by means of the multiconductor cable 890.

When the appropriate coinage has been deposited in the coin box 790 and a selector switch such as a switch 805 has been depressed adjacent selector switches 810 through 820 are isolated and rendered inoperative as the pole 840 separates from the input terminal 860 and the output terminal 865. This insures that only one product at a time may be selected.

Module driver 725 is activated as described with respect to the circuit of FIG. 8 by the pole 845 closing the circuit between input contact 870 and output contact 875 along the cable 890. The energization of module driver 725 cycles the related can vending module 705 as previously discussed.

When the can vending module 705 is cycled, the product to be vended, corresponding to the product A4 in the can vending module 5 of FIG. 1 is dropped into a product delivery area 900 located behind a product access door 910. The product access door 910 is mounted on the cabinet 702 of the vending machine 700 along an elongated upper edge 930 so that a lower elongated edge 940 of the door 910 may be swung away from the cabinet 702 thereby making available the product access region 900 so that a purchaser may access the delivered product, such as product A4. When the door 910 is swung away from the cabinet 920, a safety switch 950 connected by a cable 960 to the power supply 780 disables power to all of the can vending modules such as the modules 725 through 740. Thus, if the door 910 is opened while a can vending module 705 through 720 is being cycled by its associated module driver 725 through 740, power to the module being cycled, from the power supply 780 will be immediately interrupted causing that module to return immediately to its uncycled state. This additional security feature cooperates with the locking mechanism on the lever 210 of FIG. 7 to make it more difficult for a thief to improperly obtain products which have not been paid for.

It will be understood that the vending machine 700 and the associated modules 705 through 720 may be used with any product and are not restricted to cans. All that is required is that the product be of an appropriate size and shape so that the vending modules 705 through 720 may properly dispense the product, one item at a time.

Although various modifications might be suggested by those skilled in the art, it should be understood that we wish to embody within the scope of the claims of the patent warranted hereon all such modifications as reasonably and properly come within the scope of our contribution to the art.

We claim as our invention:

1. A product vending module comprising:

means for delivery of a supply of products to be vended;

queuing means cooperating with said delivery means to controllably permit products supplied by said delivery means to be delivered one at a time to a product vending means;

a product delivery region adjacent said product vending means, said product vending means includes, slidable product release means adapted to receive the next product to be vended from said queuing means, means for viewing each product received by said product release means, and control means adapted to in sequence, (1) slidably retract said product release means from an initial position dropping the product to be vended into said product delivery region, (2) return said product release means to said initial position, and (3) actuate said queuing means to release the next product to be vended to said slidable product release means.

2. The product vending module according to claim 1, wherein said means for delivery comprises:

an elongated, U-shaped chute having a bottom, with an upper and a lower surface, and a pair of intersecting side walls, with said upper surface being located between said side walls;

said chute having means for support to support said chute at an angle with respect to a horizontal;

said chute having a first and a second end with said first end being higher than said second end with respect to the horizontal;

the products to be vended being placed on said upper surface of said bottom of said chute, between said side walls, and urged toward said second, lower end of said chute;

said queuing means comprises:

a first and a second queuing pin, each movably affixed to a first lever means rotatably attached to said lower surface of said bottom of said chute;

said two pins each extending upwardly into said chute, through a first and a second hole selectively located in spaced relationship in said bottom of said chute;

said first queuing pin being located upwardly of said second pin, toward said first end of said chute; the region between said two queuing pins forming a queuing region;

said queuing means including further, means for queuing control of said lever means operative to:

extend said second queuing pin into said chute while simultaneously retracting said first queuing pin to allow a product to slide down said bottom of said chute and enter said queuing region and for selected period of time, to extend said first queuing pin into said chute thereby blocking any downward movement by the supply of products to be vended while simultaneously retracting said second queuing pin to allow a product previously queued in said queuing region to slide down said bottom of said chute to said means for product vending.

3. The product vending module according to claim 2 having further, a third and a fourth queuing pin, said first and said third queuing pins being oriented in spaced relationship to one another, and joined by a rigid connecting member to form a first U-shaped queuing structure;

said second and said fourth queuing pins being oriented in spaced relationship to one another, and joined by a rigid connecting member to form a second U-shaped queuing structure;

said first lever means being rotatably affixed to said rigid connecting member of both of said queuing structures, said third and said fourth queuing pins of said first and said second queuing structures respectively being capable of being extended into said chute, through a third and a fourth hole selectively located in said bottom of said chute.

4. The product vending module according to claim 2 wherein:

said queuing control means includes, a first spring member operative to normally bias said first lever means to retract said first queuing pin and to extend said second queuing pin into said chute;

a first electrical means for controlled movement of said lever means operable to overcome said bias due to said first spring to extend said first queuing pin into said chute and retract said second queuing pin from said chute, an electrical control means operative to selectively energize said first electrical means for controlled movement for selected intervals of time.

5. A product vending module comprising:

means for delivery of a supply of products to be vended;

queuing means cooperating with said delivery means to controllably permit products supplied by said delivery means to be delivered one at a time to a product vending means;

said product vending means cooperating with said queuing means to deliver the individual products to an adjacent product delivery region;

said means for delivery comprises:

an elongated, U-shaped chute having a bottom, with an upper and a lower surface, and a pair of intersecting side walls, with said upper surface being located between said side walls;

said chute having means for support to support said chute at an angle with respect to a horizontal;

said chute having a first and a second end with said first end being higher than said second end with respect to the horizontal;

the products to be vended being placed on said upper surface of said bottom of said chute, between said side walls, and urged toward said second, lower end of said chute;

said queuing means comprises:

a first and a second queuing pin, each movably affixed to a first lever means rotatably attached to said lower surface of said bottom of said chute;

said two pins each extending upwardly into said chute, through a first and a second hole selectively located in spaced relationship in said bottom of said chute;

said first queuing pin being located upwardly of said second pin, toward said first end of said chute;

the region between said two queuing pins forming a queuing region;

said queuing means including further, means for queuing control of said lever means operative to:

extend said second queuing pin into said chute while simultaneously retracting said first queuing pin to allow a product to slide down said bottom of said chute and enter said queuing region and for selected period of time, to extend said first queuing pin into said chute thereby blocking any downward movement by the supply of products to be vended while simultaneously retracting said second queuing pin to allow a product previously queued in said queuing region to slide down said bottom of said chute to said means for product vending;

said product vending means including a movable vending door adjacent said second end of said chute, said door having a closed and an open position; and including further, a control means selectively operable to open said vending door for selected intervals of time thereby dropping the product to be vended, adjacent said door, into said adjacent product delivery region;

said queuing control means includes:

a first spring member operative to normally bias said first lever means to retract said first queuing pin and to extend said second queuing pin into said chute;

a first electrical means for controlled movement of said lever means operable to overcome said bias due to said first spring to extend said first queuing pin into said chute and retract said second queuing pin from said chute;

an electrical control means operative to selectively energize said first electrical means for controlled movement for selected intervals of time;

said product vending means additionally includes:

a second lever means rotatably attached to said means for support and operably attached at a first end to said vending door;

a second spring member affixed at a first end to said second lever means and at a second end to said means for support and operative to bias said vending door to said closed position;

a second electrical means for controlled movement of said vending door attached to said second lever means and operative to overcome said bias due to said second spring member and open said vending door;

said electrical control means being further operative to selectively energize said second electrical means for controlled movement for selected intervals of time, whereby in sequence (a) said vending door is opened thereby delivering the product adjacent said door to said product delivery region, (b) said vending door is closed, (c) said second queuing pin is retracted, simultaneously while said first queuing pin is extended into said chute permitting a previously queued product in said queuing region to be delivered adjacent said vending door while blocking movement of any other products in said chute, upward of said first queuing pin, and subsequently, (d) said second queuing pin is extended simultaneously while said first queuing pin is retracted from said chute permitting the product immediately upward of said first queuing pin to enter said queuing region.

6. The product vending module according to claim 5 wherein said vending door is a horizontal door slidable in a pair of associated horizontal tracks supported by said means for support whereby a product to be vended, which has been released from said queuing region, will slide down said bottom of said chute across said second lower end of said chute, and come to rest on a top surface of said horizontal door; said adjacent product delivery region being located below said horizontal vending door.

7. The product vending module according to claim 6 having further:

a mechanical locking means, on said second lever means, operative to block substantial horizontal movement of said vending door except when said second electrical means for controlled movement has been energized.

8. The product vending module according to claim 7 wherein said second lever means includes an elongated lever member and said mechanical locking means comprises a selectively located boring through a first end of said lever member and operable to cooperate with said second electrical means for controlled movement to selectively lock said door in said closed position.

9. A product vending module for dispensing cans one at a time comprising:

an elongated, U-shaped chute having a first and a second end, a pair of substantially parallel side walls and a bottom;

said chute being oriented at an acute angle with respect to a horizontal, with said first end being oriented below said second end; said chute being supported by a lower, module support housing;

a first and a second queuing mechanism mechanically interconnected by a lever means;

said lever means being operatively affixed to a selected surface of said bottom of said chute;

each said queuing mechanism comprising a U-shaped bracket with a first and a second rigid, elongated queuing pin joined by a rigid connecting member, said two queuing pins of each said queuing mechanism being capable of being extended into said chute through a pair of selectively located borings in said bottom of said chute, said first queuing mechanism being located on said chute lower than said second queuing mechanism and in spaced relation thereto with the region of said bottom of said chute between said two queuing mechanisms defining a queuing region;

a means for product delivery operatively supported by said lower module support housing adjacent to said first end of said chute and including a horizontally slidable vending door slidable between a closed position and an open position;

a product access area below said horizontally slidable vending door;

a control means operably connected to said lever means and said horizontally slidable vending door;

whereby said control means is operable to in sequence, (a) open said horizontal slidable vending door, thereby dropping a product positioned on said vending door into said product delivery area, (b) close said vending door, (c) retract said two queuing pins of said first, lower, queuing mechanism from said chute permitting a product positioned in said queuing region to slide down said bottom of said chute onto said vending door simultaneously while extending said two queuing pins of said second, upper, queuing mechanism thereby blocking downward movement of products positioned in said chute above said upper queuing mechanism, (d) extend said two queuing pins of said first, lower, queuing mechanism into said chute simultaneously while retracting said two queuing pins of said second, upper, queuing mechanism from said chute permitting products positioned in said chute above said upper queuing mechanism to slide downward toward said lower queuing mechanism and permitting the lowermost product in said chute to enter said queuing region.

10. An improved, multi-size can vending apparatus comprising:

a chute oriented at a selected angle with respect to a horizontal, said chute having a floor and a pair of parallel sides, essentially perpendicular to said floor;

a means for queuing, including a first and a second pair of elongated, paralle, queuing pins joined by a rigid member with each said pair of queuing pins rotatably mounted beneath said floor of said chute and extendable, essentially perpendicular to said floor of said chute, into said chute through a set of selectively located holes in said floor of said chute, with the region between said set of holes associated with said first set of queuing pins and the set of holes associated with said second set of queuing pins forming a queuing region;

and including further, a spring operably affixed to said means for queuing so as to bias said first set of queuing pins so as to cause said first set of pins to extend into said chute and to cause said second set of pins to retract from said chute;

a movable vending door slidingly affixed to a front, product delivery end of said chute and retractable beneath said front end of said chute;

a means for electrical control operably affixed to said movable door and said means for queuing and operable in sequence to retract said horizontally slidable door thereby dropping the item to be vended into a product delivery area, close said door, retract said first set of queuing pins simultaneously while extending said second set of queuing pins thereby permitting the next product to be vended to slide down said floor of said chute onto said movable door, permit said second set of queuing pins to retract and said first set to extend into said chute, under the influence of said spring, thereby permitting the next product to be queued to enter the queuing region between said two sets of queuing pins.

11. An article vendor for dispensing articles one at a time for use in a vending machine comprising a hollow chute for a selected cross section, having an elongated bottom member, said chute being oriented at a selected angle with respect to a horizontal with a front end lower than a rear end such that articles to be vended may slide down said bottom member of said chute to said front end of said chute under the influence of gravity, a means for dispensing located at said lower front end of said chute and controllably operable to release an article to be dispensed, a means for queuing located on said chute above said means for dispensing and operable to supply articles to be dispensed, one at a time to said means for dispensing, a first and a second electrical solenoid, a first and a second means for linking, said first means for linking being operably connected to said first solenoid and to said means for dispensing;

said second means for linking being operably connected to said second solenoid and to said means for queuing for releasing one article at a time to said means for dispensing;

means for electrical control operably connected to said first and said second solenoid and including means to energize said first solenoid for a preselected interval of time thereby operating said first means for linking to dispense an article, and further having means for subsequently sensing that the article should have been dispensed, and having further means for energizing said second solenoid whereby said second means for linking is operated to release a queued product which may then slide down said hollow chute to said means for dispensing while subsequent products in said chute are retained behind said means for queuing and further including means for queuing a next product after a selected period of time.

12. A vending apparatus for use in a vending machine for dispensing articles in a controlled fashion, one at a time, comprising a hollow chute oriented at an angle with respect to the horizontal having a queuing area therein at a selected location and a lower first end whereby selected products may slide down a first surface of said hollow chute, through said queuing area, and slide out said first end of said hollow chute under the influence of gravity;

a dispensing area located adjacent said lower, first, end of said hollow chute, a means for dispensing adjacent to said dispensing area, a first and a second means for linking and a first and a second means for queuing, said first means for linking being operably connected to said means for dispensing;

said second means for linking being operable connected to said first and second means for queuing, said first and said second means for queuing being operably supported by said chute and each being extendable into said chute to block movement of the articles in said chute under the influence of gravity, and including a first means for biasing operable to extend said first means for queuing into said chute and to retract said second means for queuing from said chute, an electrical control means connected to said first and said second means for linking and operable to actuate said first means for linking, to dispense an article previously positioned at said dispensing area having further means to subsequently actuate said second means for linking thereby retracting said first means for queying and extending said second means for queuing whereby a previously queued article located in a queuing area between said two means for queuing may be released from said queuing area to said hollow chute to slide down said hollow chute to said dispensing area adjacent said first end of said hollow chute with said second means for queuing operable to retain additional articles above but outside of said queuing area, having further means, after a selected period of time, operable to permit said biasing means to retract said second means for queuing, and extend said first means for queuing thereby permitting a next article to enter said queuing area under the influence of the force of gravity.

13. The vending apparatus according to claim 12, wherein said first and said second means for queuing each comprise a U-shaped queuing means having a first and a second queuing arm joined by a central member, perpendicular to said first and second arms, with said first and said second U-shaped queuing means being oriented such that said first and said second arms of each queuing means extend through a respective first and second perforation in said floor of said chute adjacent to said queuing area.

14. The vending apparatus according to claim 13, wherein said first means for linking comprises a first fixed bracket, and an actuator arm rotatably mounted onto said first fixed bracket; said actuator arm having a first and a second end, said first end being pivotably connected to said means for dispensing, said second end being pivotably connected to a movable member associated with a first solenoid; said first solenoid being connected to said means for electrical control.

15. The vending apparatus according to claim 14, wherein said second means for linking comprises a second fixed bracket operably attached, near said queuing region, to said hollow chute, a queuing lever rotatably attached to said second fixed bracket having a first and a second end with said first end rotatably attached to said first U-shaped means for queuing and said second end being rotatably attached to said second U-shaped means for queuing.

16. The vending apparatus according to claim 15, wherein said means for electrical control comprises further a means for sensing operable to detect the operation of said means for dispensing.

17. The vending apparatus according to claim 16, wherein said means for dispensing comprises a rectangular sheet member slidingly mounted within a horizontal bracket affixed to said hollow chute and having further a first surface comprising said dispensing area, said sliding member being pivotably connected to said first end of said first actuator arm and operable to be slid from under the article to be dispensed by said first actuator arm, the article to be dispensed then falling, under the influence of gravity, into a dispensing region.

18. The vending apparatus according to claim 17, having further a second means for biasing whereby said sheet member is biased closed under the influence of said second means for biasing except when said first solenoid has been energized under the control of said means for electrical control.

19. The vending apparatus according to claim 18, wherein said first means for biasing comprises at least one biasing spring operably connected to said second U-shaped means for queuing such that said second U-shaped means for queuing is normally retracted and said first U-shaped means for queuing is normally extended except when said second means for linking has been operated by said means for electrical control.

20. The vending apparatus according to claim 14, wherein said electrical control means comprises:

a first silicon controlled rectifier operably connected to selectively energize said first solenoid.

21. The vending apparatus according to claim 20, with said control means comprising further a first and a second electrical time delay each comprising a timing capacitor and a selected means for current supply operative to charge and discharge said timing capacitor so as to control the sequential activation of said means for dispensing and said first and second means for queuing.

22. A product vending machine comprising:

a housing;

a plurality of product vending modules mounted within said housing;

a product delivery region within said housing adjacent each member of said plurality of product vending modules and protected by a manually movable product access door affixed to said housing;

a plurality of means for product selection, affixed to said housing, each member of said plurality of means for product selection being operatively connected to a respective member of said plurality of product vending modules;

a transparent member affixed to said housing adjacent each said member of said plurality of product vending modules whereby a prospective purchaser may view the next product to be vended from each member of said plurality of product vending modules thereby dispensing with any need to have auxiliary dispensing indicia affixed to said housing;

a source of electrical energy operatively connected to each said member of said plurality of product vending modules; and wherein;

each of said members of said plurality of product vending modules comprises, means for delivery of a supply of products to be disposed one at a time, queuing means cooperating with said delivery means to controllably permit products supplied by said delivery means to be delivered one at a time to a product vending means;

said product vending means cooperating with said queuing means to deliver the individual products to said product delivery region when said respective means for product selection activates said selected module;

wherein, said means for delivery comprises:

an elongated, U-shaped chute having a bottom with an upper and a lower surface and a pair of intersecting side walls, with said upper surface being located between said side walls;

said chute having means for support to support said chute at an angle with respect to a horizontal;

said chute having a first and second end with said first end being higher than said second end with respect to the horizontal;

the products to be vended being placed on said upper surface of said bottom of said chute, between said side walls and urged toward said second, lower end of said chute;

said queuing means comprises:

a first and a second queuing pin, each movably affixed to a lever means rotatably attached to said lower surface of said bottom of said chute;

said two pins each extending upwardly into said chute, through a first and a second hole selectively located in said bottom of said chute in spaced relationship;

said first queuing pin being located upwardly of said second pin, toward said first end of said chute; the region between said two queuing pins forming a queuing region;

said queuing means including further, means for queuing control of said lever means operative to:

extend said second queuing pin into said chute while simultaneously retracting said first queuing pin to allow a product to slide down said bottom of said chute and enter said queuing region and for selected period of time, to extend said first queuing pin into said chute thereby blocking away downward movement by the supply of products to be vended while simultaneously retracting said second queuing pin to allow a product previously queued in said queuing region to slide down said bottom of said chute to said product vending means;

said product vending means including a movable vending door adjacent said second end of said chute, said door having a closed and an open position; and including further, a control means selectively operable to retract said vending door for selected intervals of time thereby dropping the product to be vended, adjacent said door, into said adjacent product delivery region when said respective means for product selection operates said control means in response to a purchaser having selected a product.

23. The product vending machine according to claim 22, wherein each said vending module has further;

a third and a fourth queuing pin, said first and said third queuing pins being oriented in spaced relationship to one another, and joined by a rigid connecting member to form a first U-shaped queuing structure;

said second and said fourth queuing pins being oriented in spaced relationship to one another, and joined by a rigid connecting member to form a second U-shaped queuing structure;

said lever means being rotatably affixed to said rigid connecting member of both of said queuing structures, said third and said fourth queuing pins of said first and said second queuing structures respectively being capable of being extended into said chute, through a third and a fourth hole selectively located in said bottom of said chute.

24. The product vending machine according to claim 22, wherein each said means for product selection comprises a double-pole, single-throw switch with one normally open pole and one normally closed pole with said switches being wired in series such that only one product vending module may be activated at a time.

25. The product vending machine according to claim 22, wherein:

said housing has operatively attached thereto a means for sensing movement of said product access door;

said means for sensing being operatively connected to said source of electrical energy to block each said vending module from dispensing a product selected said associated product selection means when a movement of said product access door is sensed from a closed position to an open position.

26. The product vending machine according to claim 25 with each said module having further:

a mechanical locking means operative to block movement of said vending door except when said control means has been energized.

27. The product vending machine according to claim 22 wherein:

said queuing control means of each said module includes, a first spring member operative to normally bias said lever means to retract said first queuing pin and to extend said second queuing pin into said chute;

a first electrical means for controlled movement of said lever means to overcome said bias due to said first spring to extend said first queuing pin into said chute and retract said second queuing pin from said chute, an electrical control means operative under control of said associated means for product selection to selectively energize said first electrical means for controlled movement for selected intervals of time.

28. The product vending machine according to claim 24 wherein said electrical control means further comprises a first silicon controlled rectifier controllably operable to actuate said first electrical means for controlled movement.

29. The product vending machine according to claim 27, wherein:

said product vending means of each said vending module additionally includes:

a second spring member operative to bias said vending door to said closed position, a second layer means rotatably affixed to said vending door including further a second electrical means for controlled movement of said vending door, operative to overcome said bias due to said second spring member and open said vending door;

said electrical control means being further operative to selectively energize said second electrical means for controlled movement for selected intervals of time, whereby in sequence (a) said vending door is opened thereby delivering the product adjacent said door to said product delivery region, (b) said vending door is closed, (c) said second queuing pin is retracted, simultaneously while said first queuing pin is extended permitting a previously queued product in said queuing region to be delivered adjacent said vending door while blocking movement of any other products in said chute, upward of said first queuing pin, and subsequently, (d) said second queuing pin is extended simultaneously while said first queuing pin is retracted permitting the product immediately upward of said first queuing pin to enter said queuing region.

30. The product vending machine according to claim 29 wherein said electrical control means comprises further a second silicon controlled rectifier controllably operable to actuate said second electrical means for controlled movement.

31. The product vending machine according to claim 30 wherein said electrical control means comprises further a relay operable to selectively apply power to said first electrical means for controlled movement or to said second electrical means for controlled movement but not simultaneously to both.

* * * * *